United States Patent [19]

Jankus et al.

[11] Patent Number: 5,001,868

[45] Date of Patent: Mar. 26, 1991

[54] APPARATUS FOR GRINDING A POINT ON A TUNGSTEN ELECTRODE

[76] Inventors: Werner Jankus, Unterer Weg 6, D-4600 Dortmund; Andreas Hornung, Waterkamp 1, D-4700 Kamen, both of Fed. Rep. of Germany

[21] Appl. No.: 487,494

[22] Filed: Mar. 1, 1990

[30] Foreign Application Priority Data

Mar. 1, 1989 [DE] Fed. Rep. of Germany ..... 8902380

[51] Int. Cl.[5] ..... B24B 5/00; B24B 29/00

[52] U.S. Cl. ..... 51/131.1; 51/217 T; 51/237 R

[58] Field of Search ..... 51/129, 237 R, 217 T, 51/216 T, 219 R, 5 B, 5 C, 131.1; 65/174, 112

[56] References Cited

U.S. PATENT DOCUMENTS 970,227 9/1910 Homer ..... 51/237 R

FOREIGN PATENT DOCUMENTS 812340 1/1936 France ..... 51/219 R 570229 6/1945 United Kingdom ..... 51/219 R

*Primary Examiner*—Frederick R. Schmidt

*Assistant Examiner*—Mark A. Morris

*Attorney, Agent, or Firm*—Herbert Dubno; Andrew Wilford

[57] ABSTRACT

An apparatus for grinding a point on a tip of an elongated tungsten-electrode rod has a base, a disk rotatable on the base about a disk axis and having a disk face substantially perpendicular to the disk axis, and a drive on the base for rotating the disk about the disk axis. An elongated holder extending along a holder axis is adapted to hold the rod to be ground with its tip projecting from a front end of the holder. This holder has a rear end formed with an outwardly open annular groove. A stationary tip support having a notch open toward the disk is adapted to cradle the tip of the rod immediately adjacent the disk and an outer holder support spaced from the tip support has a notch open parallel to the notch of the tip support and is adapted to cradle the holder at the groove thereof. An inner holder support engaging the holder presses the holder and tip into the notches of the tip support and outer support. These supports are aligned along a line extending skew to the disk face and axis.

8 Claims, 2 Drawing Sheets

APPARATUS FOR GRINDING A POINT ON A TUNGSTEN ELECTRODE

FIELD OF THE INVENTION

The present invention relates to an apparatus for grinding a point on a rod. More particularly this invention concerns the preparation of tungsten electrodes.

BACKGROUND OF THE INVENTION

A tungsten electrode such as used in tungsten-inert-gas (TIG) welding must be very accurately shaped for best welding results, in particular when used in a computer-controlled process. The working end of the electrode must be ground to a point. More specifically the tip must be nearly perfectly conical with a cone axis corresponding to the longitudinal axis of the electrode rod, and the scratches formed by the grinding must radiate from the point, not run skew or transversely.

Hence such an electrode rod is shaped by engagement with a grinding disk with the electrode axis wholly skew, that is in no way perpendicular or parallel, to the rotation axis of the disk which itself is perpendicular to the grinding face of the disk. Thus seen parallel to the disk axis the rod axis is a secant, and the rod axis also forms an acute angle with the plane of the disk face.

The machine for doing this grinding normally has, in addition to the disk and its rotary drive, a holder for the electrode. This holder can pivot about an axis perpendicular to the disk axis and parallel to its face, and the electrode can be rotated in this holder about its own axis. To this end the electrode is held somewhat back of the point to be ground in a chuck- or collet-like device that itself is supported adjacent the grinding disk and that itself can be rotated about the necessary skew axis.

The tungsten electrode is typically sintered so that it is not perfectly straight and uniform. In addition the rod forming the electrode is frequently made in long pieces that are then subdivided longitudinally into individual electrodes. Thus when a particularly curved piece is chucked in the holder and ground, the point formed on the electrode will not lie on the center of the electrode but instead will lie on an extension of the axis of the part of the workpiece where it is held. This problem is aggravated when the electrode is held relatively far from its tip. These problems are present in systems wherein the electrode rod is loosely received in the holder and is guided by hand therein.

OBJECTS OF THE INVENTION

It is therefore an object of the present invention to provide an improved apparatus for grinding a point on a rod.

Another object is the provision of such an improved apparatus for grinding a point on a rod, in particular a tungsten electrode, which overcomes the above-given disadvantages, that is which forms a perfectly centered conical point on the workpiece.

SUMMARY OF THE INVENTION

An apparatus for grinding a point on a tip of an elongated tungsten-electrode rod according to this invention has a base, a disk rotatable on the base about a disk axis and having a disk face substantially perpendicular to the disk axis, and a drive on the base for rotating the disk about the disk axis. An elongated holder extending along a holder axis is adapted to hold the rod to be ground with its tip projecting from a front end of the holder. This holder has a rear end formed with an outwardly open annular groove. A stationary tip support having a notch open toward the disk is adapted to cradle the tip of the rod immediately adjacent the disk and an outer holder support spaced from the tip support has a notch open parallel to the notch of the tip support and is adapted to cradle the holder at the groove thereof. An inner holder support engaging the holder presses the holder and tip into the notches of the tip support and outer support. These supports are aligned along a line extending skew to the disk face an axis.

Thus with this system, which can be used to sharpen any rod-like workpiece, the rod in its holder is simply loaded into the supports and grinding can proceed immediately. Since the workpiece is held immediately at its tip, even if this workpiece is not perfectly straight the point will be perfectly centered on the tip. What is more, supporting the rod at the tip largely eliminates the possibility of the rod breaking.

According to another feature of this invention the supports are all carried on a turntable pivotal about an axis generally perpendicular to and intersecting the disk axis. This allows the apex angle of the point being ground to be adjusted. Furthermore the inner support includes a spring for resiliently urging the holder transversely into engagement in the tip support and outer support. The notch of the tip support is V-shaped with generally straight flanks and the tip holder is vertically displaceable on the base. This vertical displaceability allows the workpiece to be moved when a groove is worn in the grinding disk.

Furthermore in accordance with this invention the holder has a rear end formed with an outwardly open annular groove into which the outer support fits and the outer support is formed with a notch in which the rear end is engaged at the groove and this notch has at least one flank that is shaped to fit within the groove. The holder has a rear end provided with a crank so that the holder can be rotated in the supports by actuation of the crank.

The apparatus according to the invention also has a slide displaceable on the base parallel to the disk axis and carrying the supports and a spring engaged between the slide and the base for urging the supports axially of the disk axis toward the disk. An abutment is provided for limiting inward travel of the slide, so that the user simply rotates the holder and rod as the spring pulls the slide in until there is substantially no more grinding.

To assist in cutting off the sharpened rod tip, the apparatus is provided with a shield surrounding the disk and formed with a slot and a rest juxtaposed with an outer periphery of the disk. Thus the rod can be engaged in the slot and set on the rest for grooving by the disk.

DESCRIPTION OF THE DRAWING

The above and other objects, features, and advantages will become more readily apparent from the following, reference being made to the accompanying drawing in which.

SPECIFIC DESCRIPTION

Figure 1:
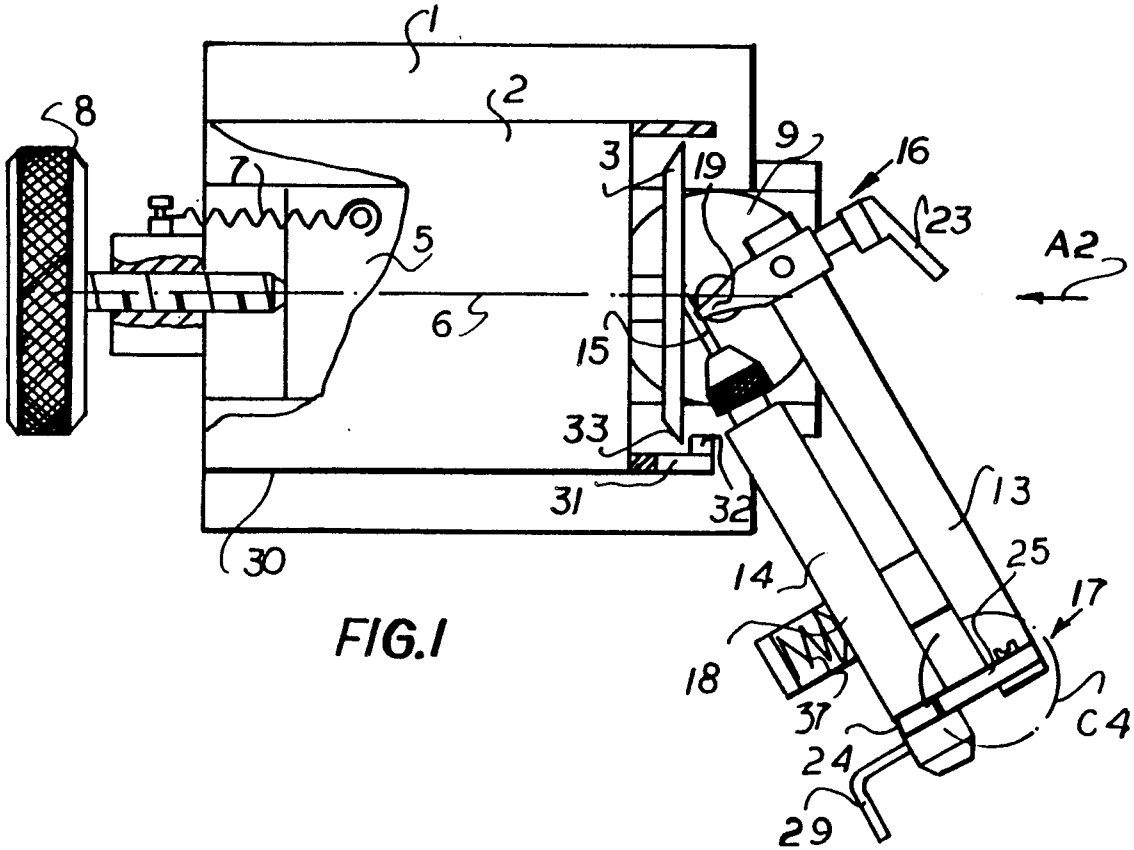
FIG. 1 is a partly diagrammatic top view of the apparatus according to this invention.
Figure 3:
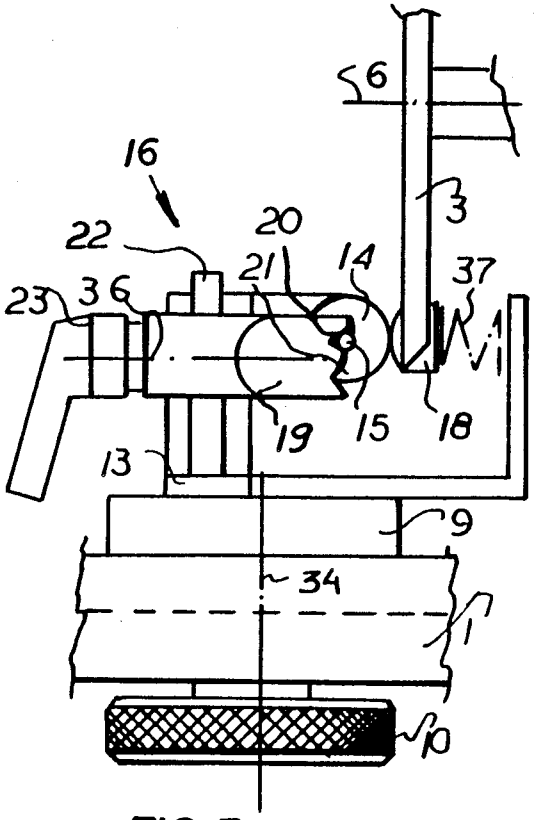
FIG. 3 is a view taken in the direction of arrow A3 of FIG. 2.
Figure 2:
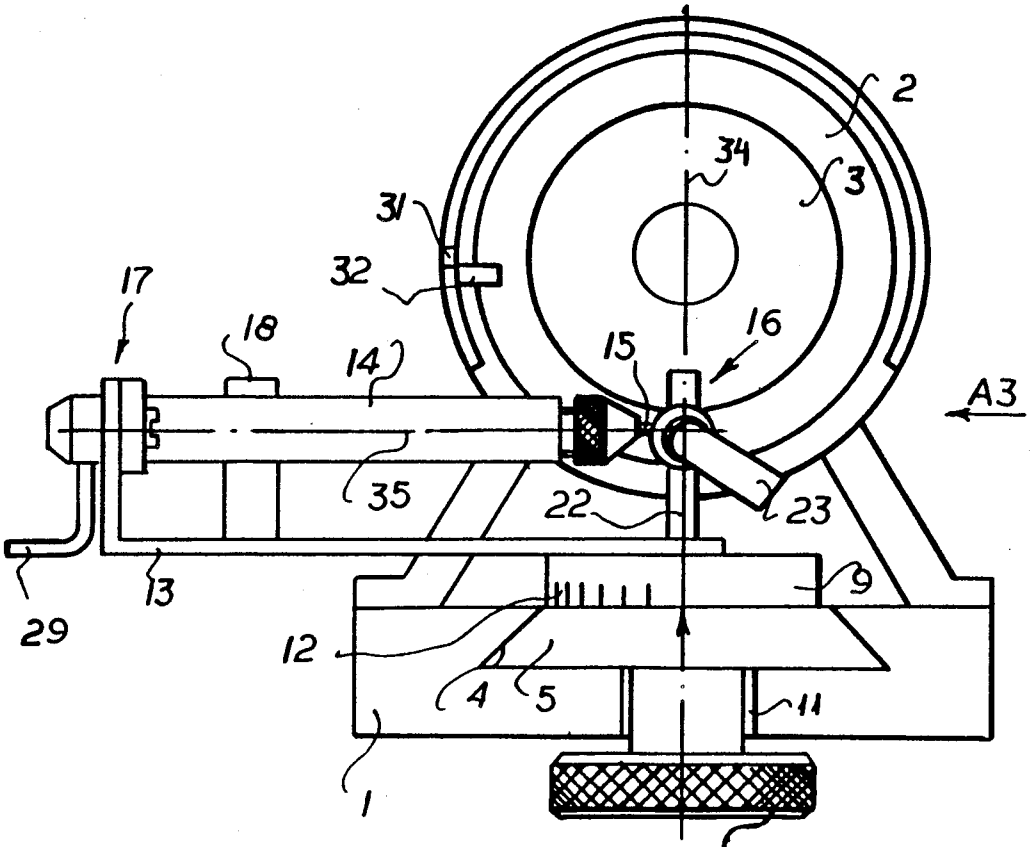
FIG. 2 is an end view taken in the direction of arrow A2 of FIG. 1.

As seen in FIGS. 1 through 3 the grinding apparatus of this invention has a stationary base 1 on which is fixed a motor 2 having an output shaft that carries a grinding disk 3 for rotation about a normally horizontal axis 6. The base 1 is formed with a dovetail slot 4 extending parallel to the axis 6 and receiving a slide 5. A spring 7 is hooked between the slide 5 and the base 1 to pull the slide backward along the axis 6. A screw abutment 8 has a front tip engaged with the slide 5 so as to set one end position of same relative to the disk 3.

A turntable disk 9 is rotatable on the slide 5 about a vertical axis 34 perpendicular to and crossing the axis 6 and can be arrested on the slide 5 in any desired angular position by means of a clamping nut 10 that projects through a slot 11 in the base 1. Indicia 12 on the disk 9 and slide 5 allow any setting to be easily reproduced.

An electrode support unit 13 wholly carried on the turntable 9 has a chuck-like sleeve holder 14 from which a tip of an electrode 15 projects, a tip support 16, and outer and inner holder supports 17 and 18. The holder 14 extends along an axis 35 that normally corresponds to the axis of the electrode 15 and that extends skew to the axis 6, that is neither parallel nor perpendicular to it nor intersecting it, and the actual axis of the tip of the rod 15 normally lies on or fairly close to the axis 35.

As best seen in FIG. 3 the tip support 16 comprises a holder plate 19 formed with two differently dimensioned tip-cradling notches 20 and 21 and carried on a post 22 extending parallel to the axis 34. A handle/-clamp 23 can rotate the plate 19 about an axis 36 equidistant between the notches 20 and 21 for reversing these notches 20 and 21. In addition this clamp 23 allows the plate 19 to be moved vertically parallel to the axis 34 on the post 22 and clamped in any position. The notch 21 is deeper than the notch 20 and is used for rods 15 of a larger diameter. In any case the notches 20 and 21 are of a depth somewhat less than the diameters of the respective rod sizes so that the plate 19 will not touch the disk 3.

Figure 4:
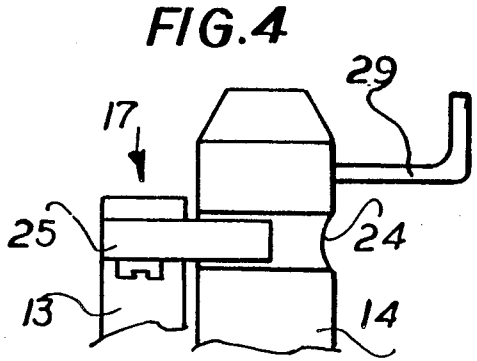
FIG. 4 is a large-scale view of the detail indicated at circle C4 of FIG. 1.
Figure 5:
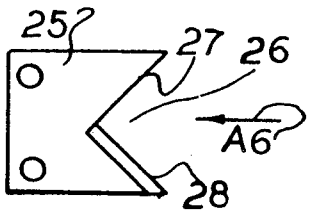
FIG. 5 is a side view of the support shown in FIG. 4.
Figure 6:
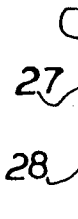
FIG. 6 is a view taken in the direction of arrow A6 of FIG. 5.

The outer support 17 as seen in FIGS. 4, 5, and 6 has a plate 25 formed with a notch 26 that fits to a groove 24 of part-circular section formed in the rear end of the holder 14. This notch 26 is open angularly relative to the axis 34 in the same direction as the notches 20 and 21 and has one flank 27 of square shape and another flank 28 whose edges are somewhat chamfered to fit well within the groove 24. Thus the position of the holder 14 relative to the axis 34 is set by the outer support 17.

The inner holder support 18 as seen in FIG. 1 is provided with a spring 37 so that it can engage the holder 14 and press the tip of the electrode 15 into one of the notches 20 or 21 and the holder 14 into the notch 26, thereby accurately establishing the position of the electrode tip. The rear end of the holder 14 is provided with a crank 29 for rotating it and the electrode 15 when thus held in the supports 16, 17, and 18.

The motor 2 has as shown in FIG. 1 a shield 30 formed on its front end with a slot 31 and with a rest 32 adjacent an edge 33 of the disk 3. Thus an electrode 15 in a holder 14 can be inserted into this slot 31 for scoring so it can subsequently 15 be longitudinally subdivided.

To grind the tip of an electrode rod 15 it is first inserted into the holder 14 with a predetermined length projecting from the front holder end. Then the electrode tip is fitted to, for instance, the upper notch 20 and the holder 14 is forced down between the holder supports 17 and 18, momentarily compressing the spring 37. During this fitting of the electrode 15 and holder 14 to the support unit 13 the entire support unit 13 and turntable 9 can be pulled against the force of the spring 7 somewhat away from the rotating disk 3.

Thereafter the crank 29 is rotated with the electrode tip pulled against the wheel 3 by the spring 7 until a perfectly conical tip is formed on the electrode 15. Since the electrode 15 itself is supported immediately adjacent the grinding wheel 3, any curvature in the electrode upstream of the tip support 16 will not have a significant effect on the shape to which the workpiece is ground.

After grinding the shaped electrode 15 in its holder 14 is removed from the supports 16–18 and is scored by fitting the tip through the slot 31 and rotating the holder 14 to form a groove all around the rod 15 at some location back from the newly ground tip. Then this newly ground tip is broken off the electrode rod 15, the holder 14 is loosened to advance the rod the desired length, and the operation is repeated.

We claim:

1. An apparatus for grinding a point on a tip of an elongated tungsten-electrode rod, the apparatus comprising:

a base;

a disk rotatable on the base about a disk axis and having a disk face substantially perpendicular to the disk axis;

drive means on the base for rotating the disk about the disk axis;

a slide displaceable on the base parallel to the disk axis;

a turntable pivotal about an axis generally perpendicular to an intersecting the disk axis on the slide;

an elongated holder on the turntable extending along a holder axis and adapted to hold the rod to be ground with its tip projecting from a front end of the holder, the holder having a rear end formed with an outwardly open annular groove;

a tip support on the turntable having a V-shaped notch open toward the disk and adapted to cradle the tip of the rod immediately adjacent the disk;

an outer holder support on the turntable spaced from the tip support, having a notch open parallel to the notch of the tip support, and adapted to cradle the holder and fit in the groove thereof; and an inner holder support engaging the holder between the outer support and the tip support and pressing the holder and tip into the notches of the tip support and outer support, the supports being aligned along a line extending skew to the disk face and axis with the inner holder support to one side of the line and the tip support and outer holder support to the opposite side of the line, the holder axis extending along the line when the holder is fitted to the supports.

2. The apparatus defined in claim 1 wherein the inner support includes a spring for resiliently urging the holder transversely into engagement in the tip support and outer support.

3. The apparatus defined in claim 1 wherein the notch of the inner support has generally straight flanks.

4. The apparatus defined in claim 1 wherein the tip holder is vertically displaceable on the base.

5. The apparatus defined in claim 1 wherein the notch of the outer support has at least one flank that is shaped to fit within the groove.

6. The apparatus defined in claim 1 wherein the holder has a rear end provided with a crank, whereby the holder can be rotated in the supports by actuation of the crank.

7. The apparatus defined in claim 1, further comprising spring means engaged between the slide and the base for urging the supports axially of the disk axis toward the disk.

8. An apparatus for grinding a point on an elongated rod, the apparatus comprising:

a base;

a disk rotatable on the base about a disk axis and having a disk face substantially perpendicular to the disk axis;

drive means on the base for rotating the disk about the disk axis;

an elongated holder to which the rod to be ground is fitted with a tip of the rod projecting from a front end of the holder;

a tip support directly engageable with and holding the tip of the rod immediately adjacent the disk;

an outer holder support engageable with and holding the holder at an outer holder end spaced from the disk;

an inner holder support engaging the holder and pressing the holder and tip into the tip support and outer support, the supports being aligned along a line extending skew to the disk face and axis; and a shield surrounding the disk and formed with a slot and a rest juxtaposed with an outer periphery of the disk, whereby the rod can be engaged in the slot and set on the rest for grooving by the disk.

* * * * *